US008181574B2

(12) United States Patent
Petermann

(10) Patent No.: US 8,181,574 B2
(45) Date of Patent: May 22, 2012

(54) DISPLAYING DATA IN A MACHINE WHICH PROCESSES PRINTING MATERIAL

(75) Inventor: Rudolf Petermann, Wiesloch (DE)

(73) Assignee: Heidelberger Druckmaschinen AG, Heidelberg (DE)

( * ) Notice: Subject to any disclaimer, the term of this patent is extended or adjusted under 35 U.S.C. 154(b) by 1887 days.

(21) Appl. No.: 10/733,484

(22) Filed: Dec. 11, 2003

(65) Prior Publication Data

US 2004/0168601 A1 Sep. 2, 2004

(30) Foreign Application Priority Data

Dec. 12, 2002 (DE) ..... 102 57 978

(51) Int. Cl.
*B41F 33/00* (2006.01)
*B41F 1/54* (2006.01)
*B41F 33/02* (2006.01)

(52) U.S. Cl. ..... 101/483; 101/484

(58) Field of Classification Search ..... 101/365, 101/45, DIG. 47, 483–485; 364/519, 525, 364/552; 382/112, 167
See application file for complete search history.

(56) References Cited

U.S. PATENT DOCUMENTS

| | | | | | |
|---|---|---|---|---|---|
| 4,639,776 | A | * | 1/1987 | Foerster et al. | 348/61 |
| 4,641,244 | A | * | 2/1987 | Wilson et al. | 700/160 |
| 4,648,048 | A | * | 3/1987 | Dorn et al. | 382/167 |
| 4,977,832 | A | * | 12/1990 | Walter | 101/365 |
| 5,163,012 | A | | 11/1992 | Wuhrl et al. | 364/552 |
| 5,511,148 | A | * | 4/1996 | Wellner | 358/1.6 |
| 6,748,860 | B2 | | 6/2004 | Loeffler et al. | 101/365 |
| 7,394,564 | B2 | | 7/2008 | Kiyohara | 358/1.9 |
| 2004/0000241 | A1 | | 1/2004 | Kiyohara | 358/1.9 |

FOREIGN PATENT DOCUMENTS

| | | | |
|---|---|---|---|
| DE | 3924989 | | 2/1991 |
| DE | 4129602 | | 3/1992 |
| DE | 4413230 | | 10/1995 |
| DE | 10006164 | | 9/2000 |
| EP | 0680222 | * | 4/1995 |
| GB | 2288367 | | 10/1995 |
| JP | 10307331 | * | 5/1997 |
| JP | 10307331 | * | 11/1998 |
| JP | 2004-34375 | | 2/2004 |

OTHER PUBLICATIONS

Translation of Rejection Notice dispatched by the Japanese Patent Office Sep. 29, 2009 in related Japanese Patent Application No. 2003-414774.

* cited by examiner

*Primary Examiner* — Ren Yan
*Assistant Examiner* — Marissa Ferguson Samreth
(74) *Attorney, Agent, or Firm* — Davidson, Davidson & Kappel, LLC

(57) ABSTRACT

A device is described for displaying data (13) during process sequences in machines (2) which process printing material. The device is provided for the purpose of graphically superimposing the data (13) to be displayed on the printing material (14).

14 Claims, 3 Drawing Sheets

DISPLAYING DATA IN A MACHINE WHICH PROCESSES PRINTING MATERIAL

This claims priority to German Patent Application No. 102 57 978.4, filed Dec. 12, 2002 and hereby incorporated by reference herein.

BACKGROUND

The present invention relates to a device for displaying data during process sequences in machines which process printing material.

Machines which process printing material, such as printing presses or even folding machines, currently have an array of operating devices, using which the operator may intervene in the process sequences of a machine of this type and which also have the function of communicating data of the process sequence to the operator. The data that characterizes the process sequence of a printing press also includes the values for the ink zone setting on the inking units of the individual printing units of a printing press. For this purpose, it is necessary to display the ink zone opening of each inking unit and therefore of each printing ink used in the printing process, in order to thus give the operator the ability to change the ink zone setting and therefore the opening of the ink zones on the individual inking units.

Such an ink zone display is known from German Patent Application No. 100 06 164 A1 (hereby incorporated by reference herein, as is GB Patent Application No. 2 288 367), among other sources, in this case the ink zone display including individual light-emitting diodes which are positioned under a glass pane, the light-emitting diodes being activated in such a way that the number of illuminated diodes corresponds to the opening of the individual ink zones. Furthermore, it is known from this patent application that the light-emitting diodes may have different colors. In printing presses according to the related art, such an ink zone display is currently integrated into a support console for printing material in sheets, the ink zone display usually being attached underneath the sheet support, near the operator. This means that the operator must relate the ink zone values displayed to the printing material lying thereon in order to thus recognize a possible need for correction.

Such a device has the disadvantage that the values of the ink zone display are not assigned directly to the ink zones on the printing material. This has the result that the operator may make errors when assigning the ink zones to the values of the ink zone display.

BRIEF SUMMARY OF THE INVENTION

An object of the present invention is to provide a device for displaying data which avoids the disadvantages of the related art.

The present invention provides a device for displaying data (13) during process sequences in machines (2) which process printing material, wherein the device is provided for the purpose of graphically superimposing the data (13) to be displayed on the printing material (14).

The device according to the present invention for displaying data during process sequences in machines which process printing material offers the great advantage that the data may now be assigned to the corresponding printing material directly and therefore without confusion. For this purpose, the data to be displayed is graphically superimposed on the printing material, so that the operator does not have to perform this superposition and assignment himself, but rather receives it displayed directly. The data to be displayed is thus spatially assigned directly to the printing material in such a way that it is displayed precisely superimposed over the point of the printing material to which it also directly belongs.

In a first embodiment of the present invention, the data to be displayed is displayable on the physically existing printing material using a projection device. In this embodiment, the printing material is laid on a console which may be illuminated using a projection device. When printing material is laid on the console, the data to be displayed is projected directly onto the printing material using the projection device and is therefore graphically superimposed on this material. The data to be displayed is thus actually displayed on the point of the printing material to which it belongs. Confusion with data which belongs to a closely neighboring point on the printing material is thus obviously reduced.

Furthermore, the data to be projected is values for the opening of ink zones in at least one inking unit of a printing press. For displaying the opening of ink zones, it is especially important that the values displayed for the opening of the ink zones correspond to the ink zones in the print image of the printed printing material. Otherwise, the operator would change the incorrect ink zones, via, e.g., corresponding ink control keys, and thus negatively influence the print image. This is prevented using the present embodiment.

A data or video projector having a lens system connected upstream is advantageously provided as the projection device for projecting the data to be displayed. Modern data or video projectors currently have an image which is sufficiently bright that they are capable in principle of projecting data to be displayed on printing material. The projector is expediently attached above the printing material to be evaluated for this purpose, so that it may project the data over the entire format of the width and length of the printing material. Using the lens system, it is possible to change the size of the format projected, so that the projector may be used for different format sizes, such as the printing formats 54 cm, 74 cm, and 102 cm.

In an especially advantageous embodiment of the present invention, it is possible to set the light beam of the data or video projector in a strip shape using the lens system. This embodiment offers advantages relating to the display of the opening of ink zones, since in this case the light beam of the projector may be set in such a way that it is only incident on the regions of the printing material on which ink zone openings are to be displayed. For this purpose, the light beam of the projector is divided into multiple oblong strips whose width corresponds exactly to the ink zones, due to which the remainder of the printing material is not illuminated by the projector. However, it is also possible to have only one transverse strip in which all ink zones lie; this is expedient if the ink zones are only to be seen in a specific region of the printing material, e.g., in a middle, upper, or lower region.

In addition, the width of the light beam is variable using the lens system. This is used for the above-mentioned format adjustment.

Furthermore, an operating device is advantageously provided, using which the opening of the ink zones is adjustable and which is provided for the purpose of transmitting a signal corresponding to the particular ink zone opening to the projection device. Since the values for the opening of the ink zones projected on the printing material are not adjustable using a light pointer as in conventional separate ink zone displays, the change of the opening of the ink zones must be performed using a separate operating device in this case. If the values of the ink zone opening are changed using such an operating device, this change is made visible directly on the printing material using the projector. The operator may thus check directly on the printing material whether the operator has adjusted the correct ink zone. In order to allow this, it is advisable for the operating device to transmit a signal to the projection device in the event of a change of the ink zone opening, so that the projection device is able to project the corresponding change on the printing material. Of course, this signal may also come directly from the press controller of a printing press, which contains the changed values of the ink zone opening.

In an alternative embodiment of the present invention, there is a display device, using which it is possible to graphically display the printing material and using which it is possible to graphically superimpose the data to be displayed on this graphically displayed printing material. An embodiment of the present invention of this type has a display screen, such as a CRT or TFT display, as the display device, on which the printing material may be displayed reduced, enlarged, or in the original size. For this purpose, the printing material must either be scanned in previously in order to be able to display it on the display screen, or the data exists in digital form in any case from the prepress. Besides the printing material, the data to be displayed is also displayed on the display screen, the data being superimposed on the printing material. In the case of the ink zone displays, the values displayed for the opening of the ink zone display are thus, as in the case of projection on actual printing material, located directly at the location of the printing material to which they also actually belong. The operator thus receives a localized, direct assignment of the data displayed to the correct points of the printing material in this way. This embodiment of the present invention may therefore dispense with a projector, which makes this achievement of the object more cost-effective and simpler to handle. However, these advantages are reduced if the printing material is to be displayed in its original size, since in this case there must be a very large display screen. The alternative embodiment of the present invention is especially advantageous for difficult light conditions, since projectors then have disadvantages in regard to brightness and contrast because of their design.

The operating device or the display device also has a touch screen, using which the data to be displayed is adjustable. In this case, there does not have to be a separate input device for inputting changes of the data displayed, since the operator may change this data directly on the display screen merely by touching the display screen. Such a touch screen has been shown to be especially advantageous for the embodiment having the printing material displayed on the display screen, since in this case the ink zones displayed on the display screen, which correspond to the printing material, may be changed directly on the display screen. In this case, the display of the ink zones of the printing material, the ink zones actually existing on the printing material, and the input device for changing the values of the ink zone opening have a coincident location. Confusion by the operator is therefore virtually precluded.

The values for the opening of ink zones are also displayable in such a way that they are visually differentiable from the displayed printing material lying thereunder. In order for the data to be displayed to be visually differentiable from the printing material lying thereunder, the colors of the ink zones to be displayed and the colors of the regions of the printing material on which the ink zones are projected or displayed must differ from one another. However, this does not represent a problem if the data of the printing material is provided in digital form. If this data is present in any case from the prepress, as is the standard in modem digital workflow (process sequence), this data may be used for the purpose of changing the colors of the data to be displayed in such a way that the data to be displayed, such as the ink zone displays, may be visually differentiated perfectly from the printing material lying behind it. Thus, for example, if the data to be displayed and the region of the printing material lying thereunder are the same color, a complementary color may be used for the data to be displayed. Alternatively, a different color, which differs as much as possible in the color spectrum from the color of the printing material lying thereunder, may also be used.

BRIEF DESCRIPTION OF THE DRAWINGS

The present invention will be described and explained in greater detail in the following on the basis of several figures.

DETAILED DESCRIPTION

Figure 1:
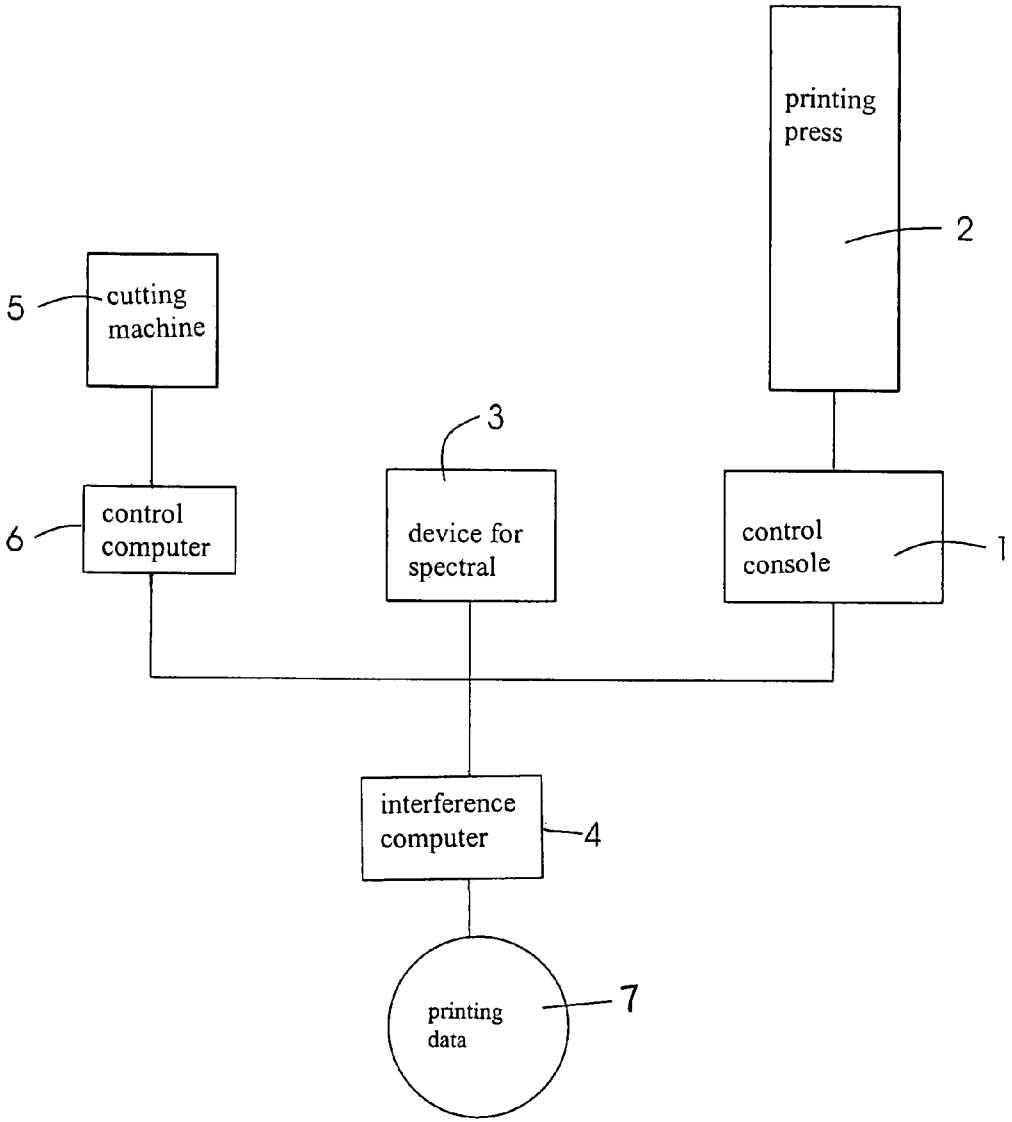
FIG. 1 shows the workflow in a modem networked printing plant.

FIG. 1 shows a detail from a printing plant operation, in which there are devices of the printing main stage and devices for further processing of printing material. These devices include a printing press 2, in this case a sheet-fed offset printing press, and a cutting machine 5. Printing press 2 is primarily controlled via a control console 1, which is shown in greater detail in FIGS. 2 and 3. Cutting machine 5 is activated via a control computer 6, in which different cutting programs are stored or appropriate changes may be performed by the operator. Furthermore, a device for spectral measurement 3 of printing material is also provided, using which printing material may be digitally scanned and the data obtained may be used for evaluating the quality of the printing. The devices cited are networked as a whole and separately with one another and are connected to a prepress interface, which may be an interface computer 4 in which the data of the prepress is stored. The data of the prepress may be supplied to interface 4 on a data carrier. Alternatively, computer 4 may also be dispensed with, and printing data 7 is then relayed directly via a data link from the prepress to the devices of the printing main stage and further processing, which are networked with one another.

Figure 2:
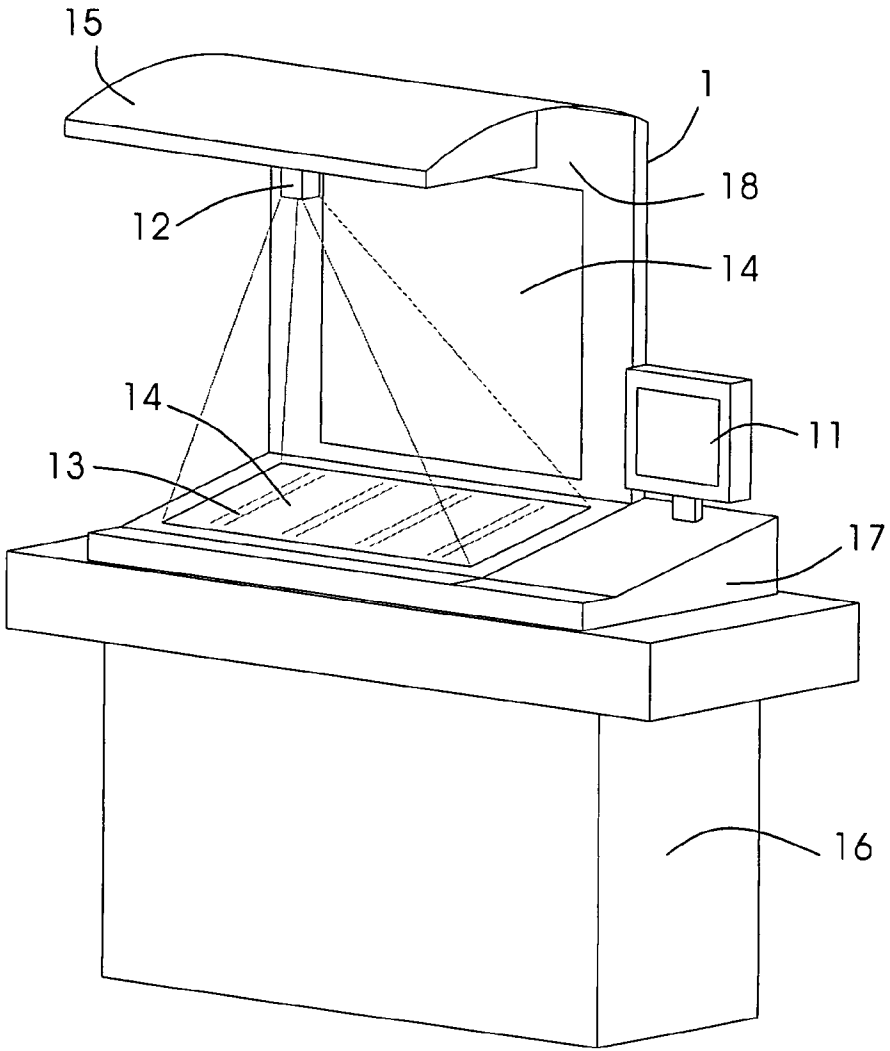
FIG. 2 shows a control console for supporting printing material having a device according to the present invention for projecting data to be displayed on the printing material.

In FIG. 2, control console 1 is shown in greater detail, so that the features of the present invention may be seen better. Control console 1 is primarily used for controlling printing press 2, it having a sheet support, on which printed printing material 14 may be laid for inspection. A device cabinet 16, in which the electrical components are housed, is located in control console 1 below the sheet support. A computer 17, which is usually a commercially available PC and which operates using a Windows operating system, is located in a further cabinet on the right side of the sheet support. Computer 17 is connected to the press computer of printing press 2 and also to a display screen 11. On display screen 11, an operator may, using graphic user interfaces, navigate in the individual menus of computer 17, make settings on printing press 2, and thus control printing press 2.

Furthermore, control console 1 has a rear wall 18, on which printed printing material 14 may be suspended for the purpose of visual inspection. A canopy 15 adjoins this wall, which has an illumination device to allow visual inspection using standard light, and also has a data and video projector 12 according to the present invention. This projector 12 allows data 13 to be projected from canopy 15 of control console 1 onto printing material 14 lying on the sheet support. In this way, data 13 to be displayed is superimposed on printing material 14 using projector 12. Projector 12 is connected to computer 17, so that particular data 13 to be displayed may be transmitted from computer 17 to projector 12. As indicated in FIG. 2, data 13 to be displayed is the bars for setting the ink zone openings in this case. These ink zones are distributed in regular intervals over the entire width of the inking unit in order to be able to vary the inking over the entire printing width in the inking unit of each printing unit of a printing press 2. The ink zones are thus also located on printed printing material 14 corresponding to the ink zones in the inking units.

The values of the ink zones set in the inking units of printing press 2 are normally displayed on display screen 11, a separate display for the ink zones also being provided in typical control consoles 1 in front of the support for printing material 14, so that the operator may thus bring the ink zone opening values displayed there into harmony with existing printing material 14 more easily. In the achievement of the object according to the present invention shown in FIG. 2, the opening values of the ink zones are no longer displayed separately, however, but rather are projected directly on printing material 14, through which the data may be superimposed on the actual ink zones present on printed printing material 14. For this purpose, printing material 14 must be fixed, appropriate fixing to be provided for each format size of printing material 14. Such fixing may be performed, for example, by laterally extendable stops for printing material 14 in connection with a suction device, through which printing material 14 is sucked against the sheet support and is prevented from slipping by the lateral stops. In the embodiment shown in FIG. 2, data 13 displayed for the values of the ink zone openings extends lengthwise over entire printing material 14 when the ink zones are opened to maximum (and, if the data 13 is displayed so that a length of the projected strip corresponds to the value of the ink zone opening, the length of the projected strip may shortens in a direct relationship as the ink zone or key is closed so that when the ink zone is closed no strip is shown). The values for each zone are distributed over the entire width of printing material 14.

Figure 3:
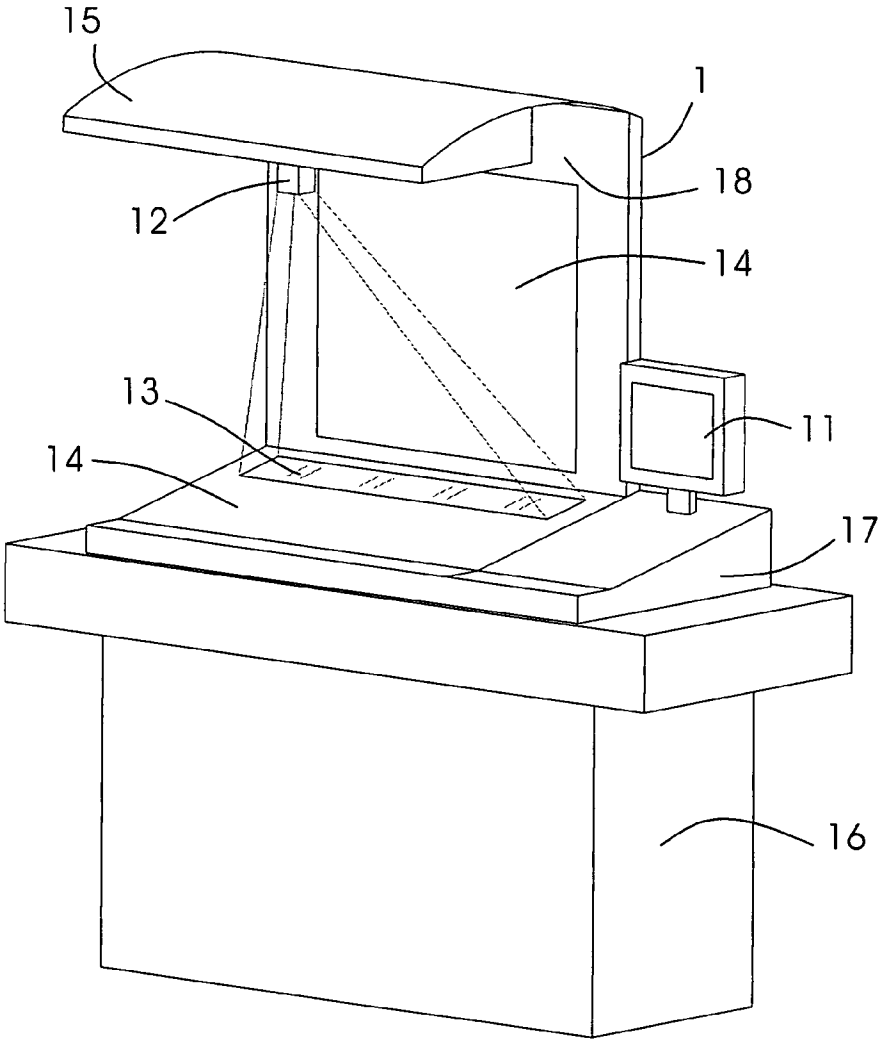
FIG. 3 shows a control console having a device according to the present invention, in which the data to be projected is restricted to a part of the printing material.

A further embodiment of the present invention may be inferred from FIG. 3, which differs from the embodiment shown in FIG. 2 in that projected data 13 for the values of the ink zone openings no longer extends lengthwise over the entire printing material 14. This means that the display bars or strips for the opening of the individual ink zones have been reduced in scale, producing the advantage that entire printing material 14 is not superimposed with data 13 and thus completely covered. It is also possible to display further data in the regions in which no ink zone values are projected in FIG. 3. Using a lens system, which is connected upstream from projector 12 or integrated therein, one may switch over from the display shown in FIG. 2 to the display of the ink zones shown in FIG. 3 in that the length of the strip in which data 13 is displayed for the ink zone setting may be varied via this lens system.

Since the printing data shown in FIG. 1 is available in digital form 7 from the prepress, it is possible to process this data in computer 17 and thus display the printed printing material on display screen 11. In addition, it is possible to measure finished printed printing material 14 when it has left printing press 2 using spectral measurement device 3, to transmit the digitized values obtained during the measurement to computer 17, and thus to display the actual state of printing material 14 on display screen 11. Data 13 may also be superimposed on this printing material 14 displayed in the actual state on display screen 11, so that, for example, the values for the ink zone setting may be superimposed on printing material 14 in the actual state on display screen 11. This may be performed in addition to the projection shown in FIGS. 2 and 3, but may also be applied as the sole alternative to projection. Since display screen 11 is usually implemented as a touch screen, the values for the opening of the ink zones may also be adjusted directly via display screen 11.

LIST OF REFERENCE NUMBERS

1 control console
2 printing press
3 spectral measurement device
4 interface for transmitting the data from the prepress
5 cutting machine
6 control computer of the cutting machine
7 data from the prepress
11 display screen
12 projector
13 data to be displayed
14 printing material
15 canopy
16 device cabinet
17 computer
18 rear wall

What is claimed is:

1. A device for displaying data during process sequences in printing material processing machines comprising:

a device graphically superimposing, on physically-existing printing material printed by a printing material processing machine, data to be displayed;

wherein the data is values for opening of ink zones in at least one inking unit of a printing press.

2. The device as recited in claim 1 wherein the superimposing device is a projection device.

3. The device as recited in claim 2 wherein the projection device is a data or video projector having an adjustable lens system.

4. The device as recited in claim 3 wherein the projection device projects light beams forming strips on the physically-existing printing material using the adjustable lens system.

5. The device as recited in claim 3 wherein the projection device projects at least one light beam, a length of the at least one light beam projected on the physically-existing printing material being variable using the adjustable lens system.

6. The device as recited in claim 1 further comprising an operating device for adjusting the opening of the ink zones, the operating device transmitting a signal corresponding to the opening of at least one ink zone to the display device.

7. The device as recited in claim 6 wherein the operating device has a touch screen for adjusting the data to be displayed.

8. The device as recited in claim 1 further comprising a display device for graphically displaying the physically-existing printing material and for graphically superimposing the data to be displayed on the graphical display of the physically-existing printing material.

9. The device as recited in claim 8 wherein the display device has a touch screen for adjusting the data to be displayed.

10. The device as recited in claim 1 wherein values for the opening of ink zones are displayable so as to be visually differentiable from the printing material.

11. A printing press having the device for displaying data as recited in claim 1.

12. The device as recited in claim 1 wherein the superimposing device is located above the printing material.

13. The device as recited in claim 12 wherein the superimposing device is a projector.

14. The device as recited in claim 12 further comprising a sheet support supporting the printing material.

* * * * *